US005704721A

United States Patent [19]

Ikehata et al.

[11] Patent Number: 5,704,721

[45] Date of Patent: Jan. 6, 1998

[54] GAP ADJUSTING DEVICE OF AN IMPACT DOT PRINTER

[75] Inventors: Tsutomu Ikehata, Sakado; Hiroshi Ikeda, Tokorozawa, both of Japan

[73] Assignee: Citizen Watch Co., Ltd., Japan

[21] Appl. No.: 863,710

[22] Filed: May 27, 1997

Related U.S. Application Data

[63] Continuation of Ser. No. 628,772, Apr. 5, 1996, abandoned.

[30] Foreign Application Priority Data

Apr. 12, 1995 [JP] Japan ..... 7-087217

[51] Int. Cl.[6] ..... B41J 11/20

[52] U.S. Cl. ..... 400/55; 400/56

[58] Field of Search ..... 400/55, 56, 57, 400/59

[56] References Cited

U.S. PATENT DOCUMENTS 4,652,153 3/1987 Kotsuzumi et al. .
4,906,115 3/1990 Bischof ..... 400/55
5,193,918 3/1993 Lohrmann et al. .
5,486,063 1/1996 Fox et al. ..... 400/56
5,529,405 6/1996 Breitenbach et al. ..... 400/56

FOREIGN PATENT DOCUMENTS 61-262161 11/1986 Japan .
3-98058 10/1991 Japan .
4-133779 5/1992 Japan .

*Primary Examiner*—John S. Hilten
*Attorney, Agent, or Firm*—Dickstein Shapiro Morin & Oshinsky LLP

[57] ABSTRACT

A gap adjusting device moves a print head vertically via a carriage shaft eccentrically supported by a displacement gear. The displacement gear is provided with a gap lever, which restricts rotational movement of a driving force transmission mechanism by abutting on a stop when a pulse motor drives the print head to move away from a platen. The pulse motor becomes out of phase, thereby defining the position as a reference position. The amount of rotation of the pulse motor is adjusted, starting from the reference position, thereby adjusting a vertical position of the print head. The reference position of the print head is established without the risk of causing damage to dot pins, by defining the initial condition of the pulse motor.

5 Claims, 6 Drawing Sheets

GAP ADJUSTING DEVICE OF AN IMPACT DOT PRINTER

This application is a continuation of U.S. application Ser. No. 08/628,772, filed Apr. 5, 1996, now abandoned.

BACKGROUND OF THE INVENTION

1. Field of the Invention

The present invention relates to a gap adjusting device of an impact dot printer in which the gap between a print head and a platen is adjusted by moving the print head toward/away from the platen in response to paper thickness, so that the print head can carry out a printing operation while retaining a consistent space between the print head and the surface of a paper material placed on the platen.

2. Description of the Prior Art

In general, an impact dot printer which carries out a printing operation by impacting dot pins against a paper material on a platen is often used for printing on a bank passbook, a pressure sensitive copying voucher or the like. In such a use, the thickness of paper varies depending on the number of pages of the bank passbook opened up, or the number of vouchers stacked up. Thus, it is preferable to conduct the printing operation while adjusting the gap between the print head and the platen depending on variation of paper thickness so as to keep a consistent space between the print head and the surface of a paper material on the platen.

A gap adjusting device has been known which is provided with a pulse motor driving a print head so as to move toward/away from a platen, as is disclosed in Japanese Utility Model Laid-Open No. Hei 3-98058. In such a gap adjusting device, a paper thickness detector detects the thickness of a paper material passing through the gap, so that a control circuit controls the amount of rotation of the pulse motor in response to a signal corresponding to the paper thickness detected by the detector. The amount of rotation of the pulse motor is transformed via a driving force transmission mechanism into the amount of movement of the print head in the direction toward/away from the platen, so that the extent of the gap is accurately adjusted.

When the position of the print head is adjusted in the direction toward/away from the platen by varying the amount of rotation of the pulse motor, it is necessary to determine the positional relationship between the pulse motor and the print head such that the pulse motor in an initial condition establishes a reference position of the print head. In this relationship, the print head is moved from the reference position by an amount corresponding to the amount of rotation the pulse motor has moved since the initial condition. For the purpose of establishing such a relationship, conventionally, the print head is first lowered toward the platen until it contacts the surface of a paper material placed thereon for restricting the movement of the print head in the direction toward the platen, whereby such a position where the print head contacts the paper material is defined as a reference position.

With this method, however, since the print head actually contacts a paper material, although an accurate positional control is achieved, it is likely to cause damage to dot pins attached to the tip end of the print head.

SUMMARY OF THE INVENTION

The present invention therefore aims to provide a gap adjusting device of an impact dot printer, which can establish a reference position of a print head without the risk of causing damage to dot pins, by defining the initial condition of a pulse motor.

According to a first aspect of the invention, there is provided a gap adjusting device of an impact dot printer, comprising: a print head; a platen defining a gap between the print head and the platen for allowing a paper material to be printed to pass through; a pulse motor imparting a driving force to the print head through a driving force transmission mechanism so as to move the print head toward/away from the platen; a paper thickness detector detecting paper thickness of the paper material passing through the gap; a controller controlling an amount of rotation of the pulse motor based on a signal, corresponding to the paper thickness, from the paper thickness detector so as to adjust an extent of the gap in response to the paper thickness by moving the print head; an abutment member connected to the driving force transmission mechanism; and a stop to be abutted on by the abutment member, for restricting movement of the print head in the direction away from the platen when the print head is driven by the pulse motor to move away from the platen; wherein the pulse motor is brought in an out-of-phase condition by abutting the abutment member on the stop so as to establish a reference position of the print head, the extent of the gap being adjusted in accordance with the paper thickness based on the reference position.

With this arrangement, the pulse motor imparts a driving force via the driving transmission mechanism to the print head, which is thereby moved toward/away from the platen. The controller controls the amount of rotation of the pulse motor based on a signal corresponding to the paper thickness detected by the paper thickness detector, whereby the gap between the print head and the platen is adjusted so as to have the optimum extent in accordance with the thickness of the paper material supplied. Thus, it is possible to carry out a printing operation with a print head positioned having a consistent space from the surface of a paper material on the platen.

Further, for establishing a reference position of the print head by bringing the pulse motor into an out-of-phase condition, that is, the initial condition, the pulse motor first drives the print head to move away from the platen. As the print head is moving away from the platen, an abutment member of the driving force transmission mechanism accordingly rotates until it reaches the stop to abut thereon so as to restrict further rotation of the driving force transmission mechanism and to thereby bring the pulse motor into an out-of-phase condition. The extent of the gap can be adjusted in response to the paper thickness based on the reference position. Since the upper position of the print head can be used as a reference position thereof, it is possible to define a reference position without having the print head actually contact the paper material. As a result, the risk of causing damage to dot pins attached to the print head can be avoided.

According to a second aspect of the invention, there is provided a gap adjusting device of an impact dot printer according to the first aspect, in which the paper thickness detector detects paper thickness of the paper material passing through the gap so as to continuously adjust the extent of the gap as the paper material advances. The paper thickness detector includes a reflection lever having a reflection face which moves according to the paper thickness for tracing the surface of the paper material, and a stationary reflecting photo sensor for emitting light toward the reflection face and receiving the reflected light from the reflection face.

With such an arrangement, while the paper material passes through the gap, the paper thickness detector continuously detects the paper thickness, so that the gap can be continuously adjusted as the paper material advances. As a result, the print head can always secure the optimum extent of gap even if the paper thickness varies during a printing operation.

The device may comprise a plurality of paper thickness detectors which are arranged a distance apart from each other in a direction orthogonal to the feeding direction in which the paper material advances passing through the gap. With the detectors thus arranged, it is possible to ensure that the gap has a consistent extent irrespective of variation of the paper thickness in the direction orthogonal to the feeding direction. At least one of the paper thickness detectors may be positioned upstream of the gap, while the others may be downstream. With the detectors thus arranged, it is possible to accommodate a printing operation with a paper material inserted from either direction along the path where the paper material advances.

BRIEF DESCRIPTION OF THE DRAWINGS

The above and the other objects, features and advantages will be apparent from the following description of the preferred embodiment taken in conjunction with the accompanying drawings wherein.

DESCRIPTION OF THE PREFERRED EMBODIMENTS

A preferred embodiment of the present invention will next be described with reference to the accompanying drawings.

Figure 1:
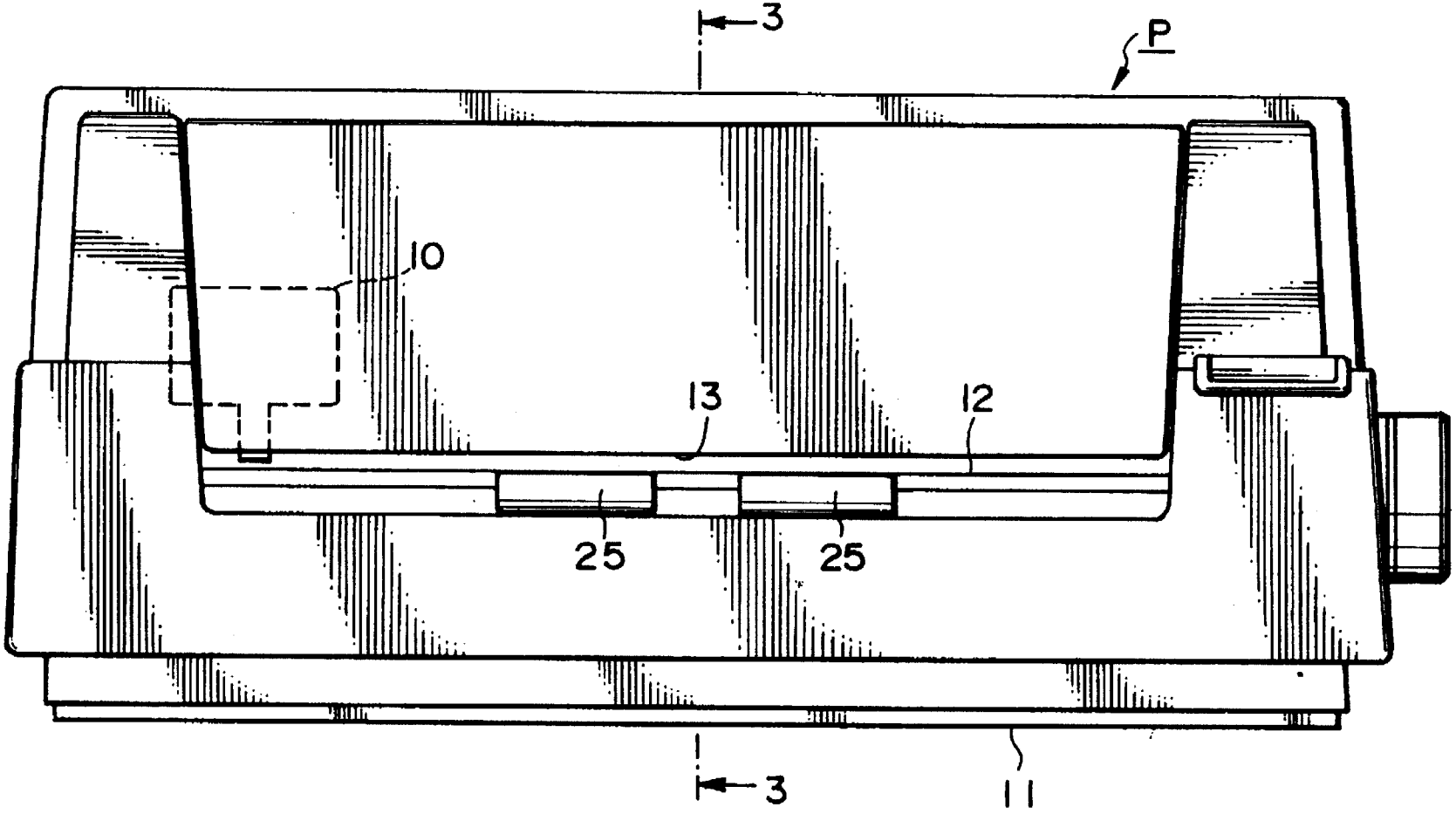
FIG. 1 is a schematic elevation showing a whole impact dot printer to which the gap adjusting device of the present invention is applied.

FIG. 1 schematically shows the whole structure of an impact dot printer to which a gap adjusting device of the present invention is applied. The impact dot printer P comprises a print head 10 for impacting dot pins against a paper material for printing. The paper material is slid on a paper feeding table 12 mounted onto the front surface of a housing 11 until the paper material reaches the print head 10 through a paper feeding main slot 13.

Figure 2:
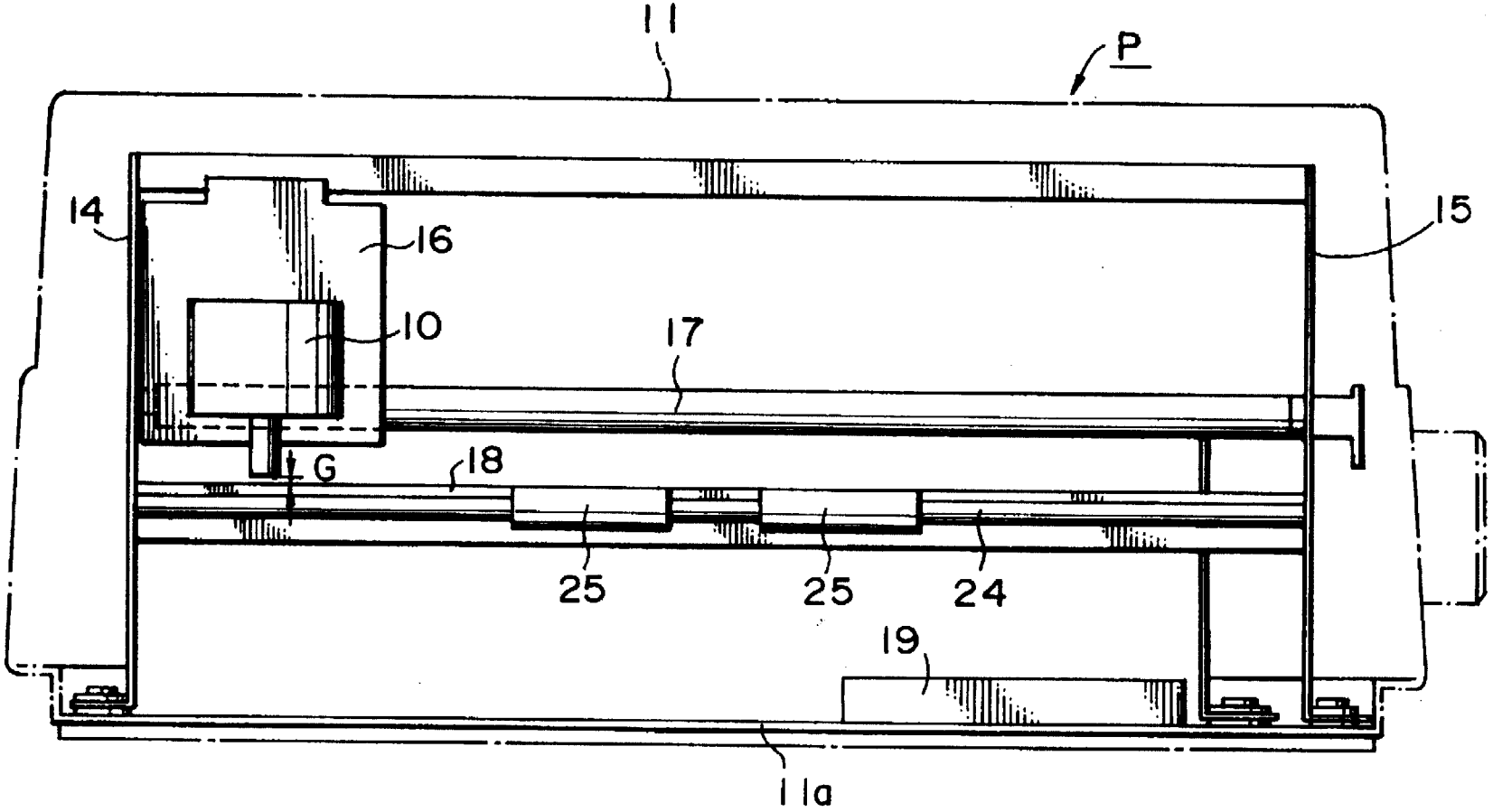
FIG. 2 is a schematic elevation showing a pair of frames within the printer.

Left and right frames 14 and 15 are fixedly attached to a base plate 11*a* of the housing 11, opposing to each other, as shown in FIG. 2. A carriage shaft 17 extends between the frames 14 and 15 for supporting horizontal movement of a carriage 16, to which the print head 10 is mounted. A platen 18 is provided below the moving path of the print head 10 along the carriage shaft 17 for receiving impacts caused by the dot pins of the print head 10. A gap G is defined between the platen 18 and the tip end of the print head 10. A paper material which is fed via the paper feeding main slot 13 passes through the gap G. The print head 10 prints on the paper material passing through the gap G, while horizontally moving along the carriage shaft 17 according to a control signal output from a CPU 19 mounted on a board on the base plate 11*a*. An ink ribbon, not shown, is mounted on the carriage 16, so that the ink ribbon can be constantly fed to a position between the print head 10 and the paper material.

Figure 3:
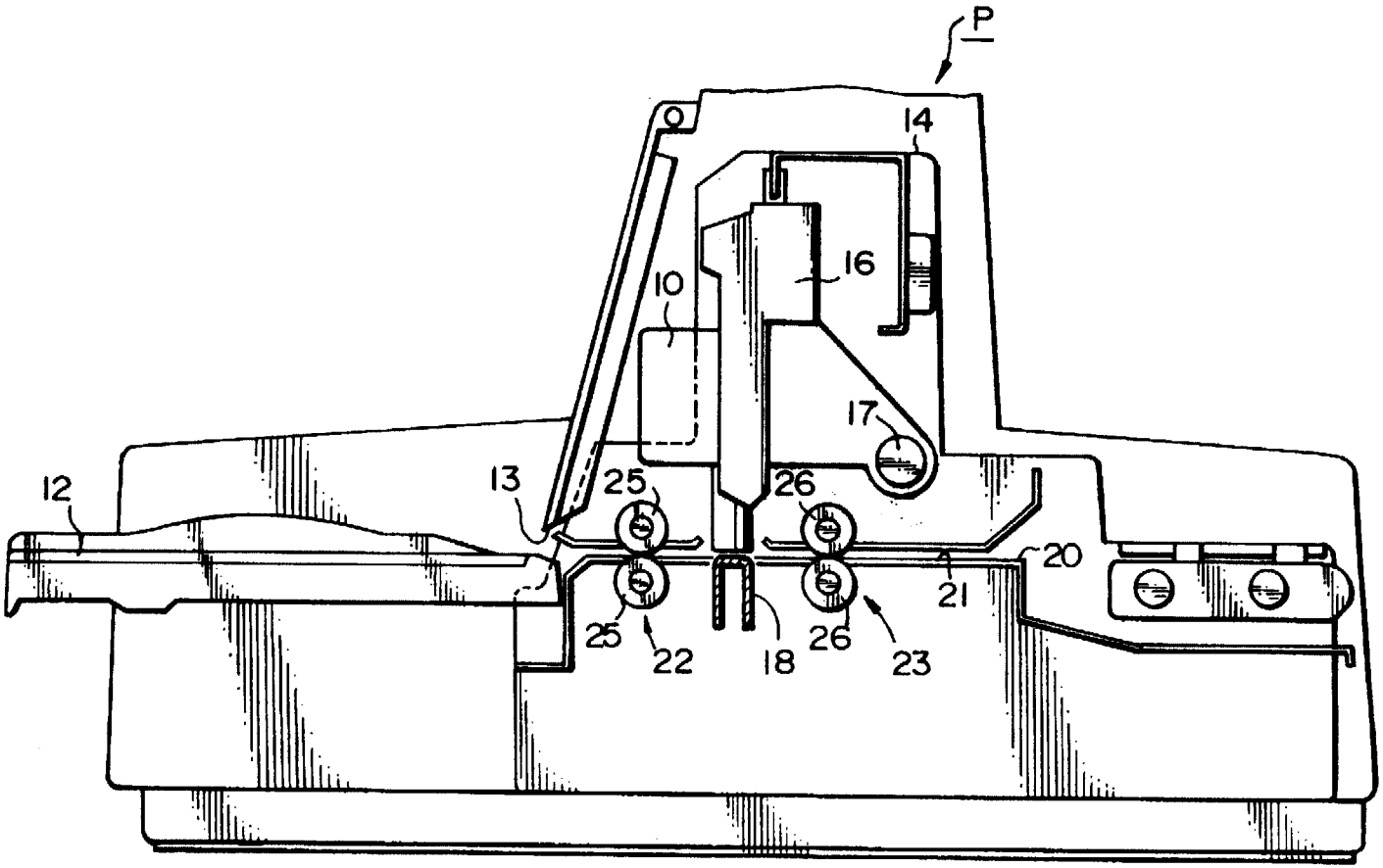
FIG. 3 is a schematic sectional view along the line 3—3 in FIG. 1, showing main elements of a driving mechanism of the printer.

As is apparent from FIG. 3, a guide plane 21 extends from the paper feeding main slot 13 to a paper feeding sub-slot 20 for horizontally guiding a paper material inserted from the paper feeding main slot 13 to the paper feeding sub-slot 20. The platen 18 is provided on the guide plane 21 at the substantially central part thereof. First and second feeding roller means 22 and 23 are positioned respectively upstream and downstream of the platen 18 in view of the paper feeding main slot 13 for forcefully advancing the fed paper material along the guide plane 21. The first and second feeding roller means 22 and 23 respectively comprise pairs of cylindrical upper and lower rollers 25, 25; 26, 26. Respective rollers 25 and 26 are mounted around roller axes 24 (see FIG. 4) which are rotatably supported between the left and right frames 14 and 15. The first and second feeding roller means 22 and 23 hold the fed paper material between the respective upper and lower cylindrical rollers 25, 25; 26, 26 so that the paper material can be fed by rotating the rollers 25 and 26 in an appropriate direction.

Figure 4:
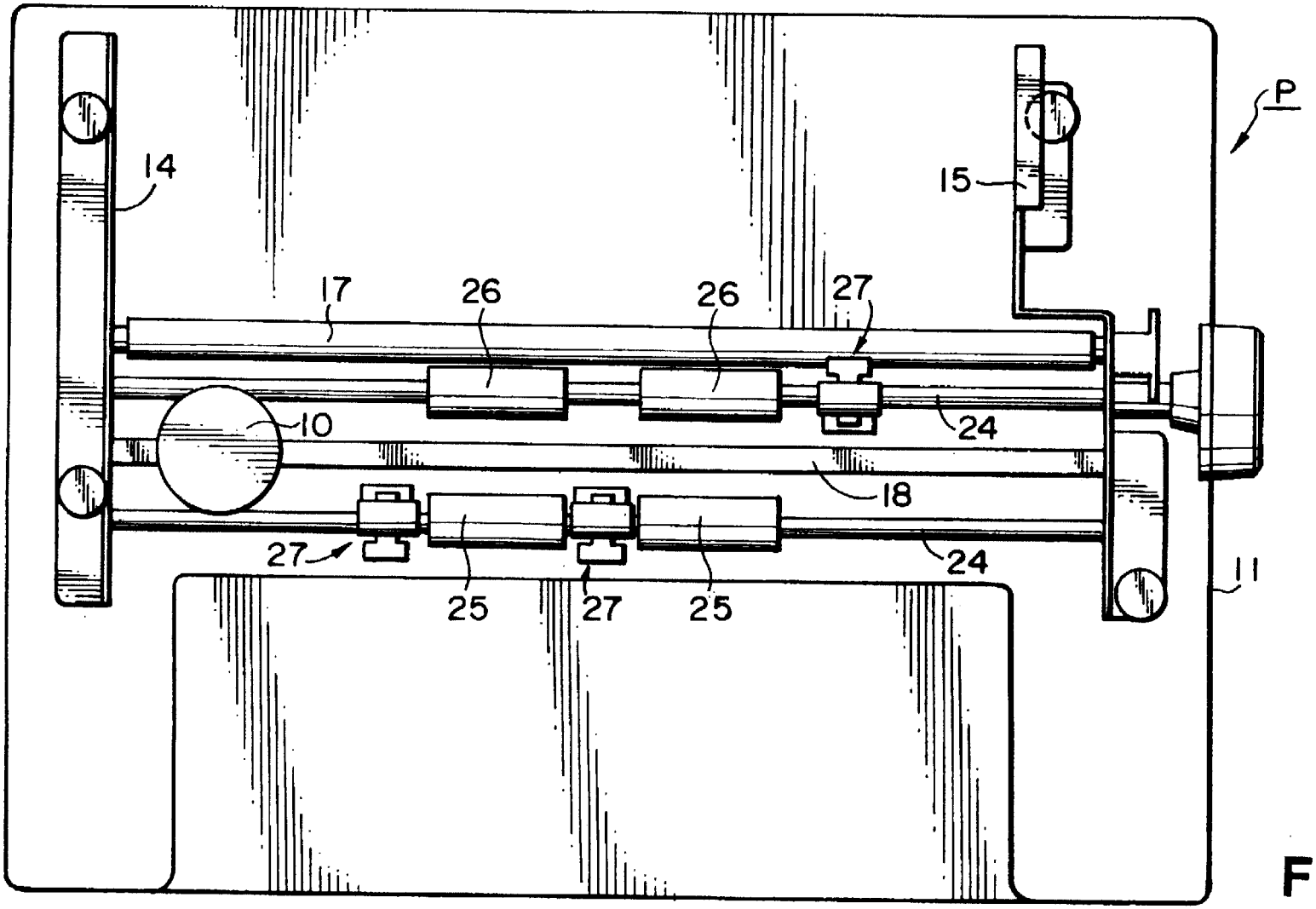
FIG. 4 is a sectional plan view schematically showing main elements of a driving mechanism of the printer.

Referring to FIG. 4, three paper thickness detectors 27 are provided adjacent to the first and second feeding roller means 22 and 23 for detecting the thickness of a paper material passing through the gap G. The three paper thickness detectors 27 are arranged at a distance from one another in the direction of paper width, with two positioned upstream and one positioned downstream of the platen 18. It is preferable to arrange the detectors 27 depending on the kind of paper material supplied to the printer. For example, two detectors 27 positioned upstream of the platen 18 would be effective for use in printing on a bank passbook, which is opened and will have different paper thickness on the left and right sides depending on the number of pages.

Figure 5:
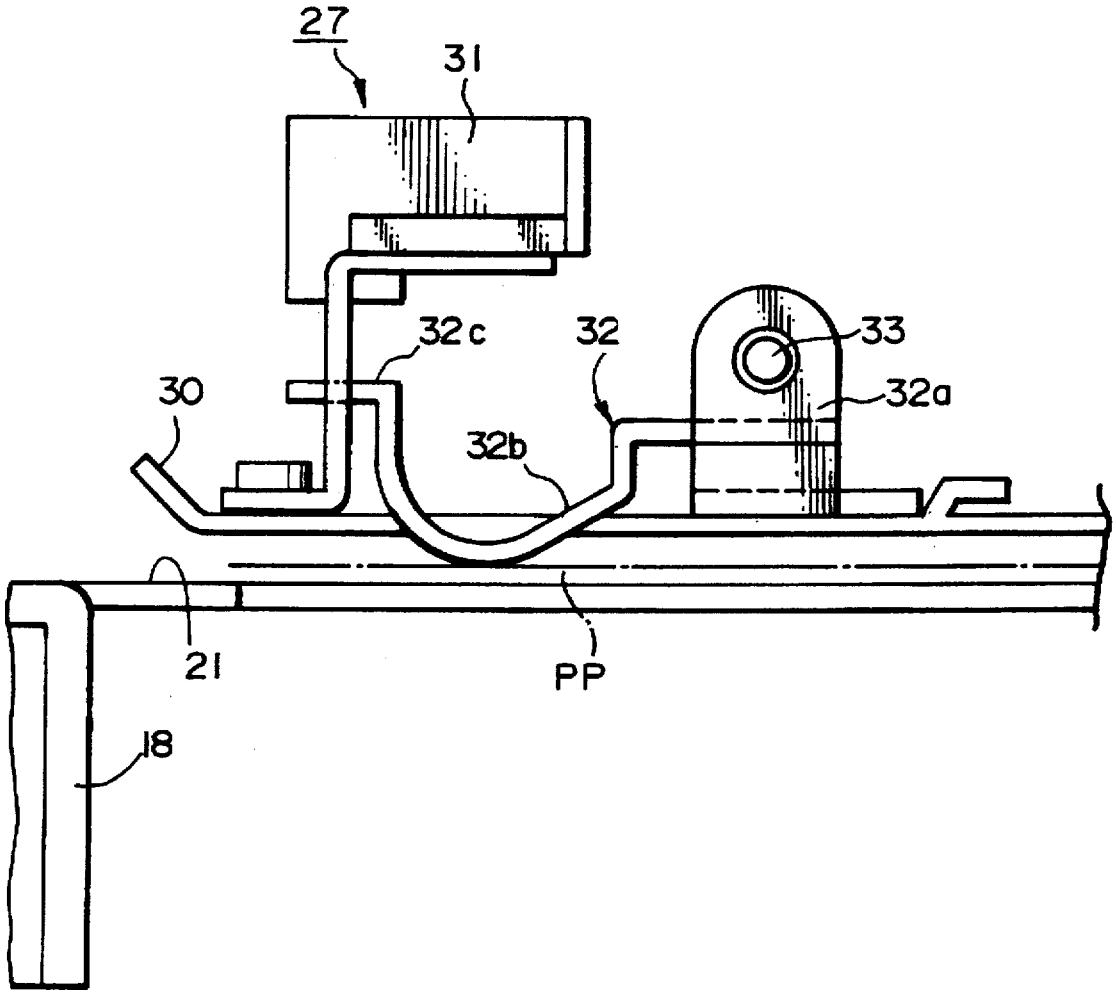
FIG. 5 is a schematic view showing a paper thickness detector.

Referring to FIG. 5, the paper thickness detector 27 includes a reflecting photo sensor 31 fixedly held by the guide plate 30 above the guide plane 21, and a reflection lever 32 supported by the guide plate 30 so as to swing. The reflecting photo sensor 31 emits light toward an object and receives the light reflected from the object, thereby measuring the distance to the object based on the light intensity distribution of the received light. The reflection lever 32 has a supporting section 32*a* supported by an axis 33, a curved section 32*b* connected to the supporting section 32*a* for tracing the surface of a paper material PP passing through the gap G, and a reflection face 32*c* formed continuously from the curved section 32*b* for reflecting the light emitted from the photo sensor 31 back to the photo sensor 31. The light emitted from the photo sensor 31 is reflected at the reflection face 32*c* back towards the photo sensor 31 so that the photo sensor 31 can detect the reflected light. During this process, the reflection face 32*c* is moved vertically according to the thickness of a paper material PP which the curved section 32*b* traces. As a result, the thickness of the paper material PP passing through the gap G can be detected. The photo sensor 31 outputs a distance signal, corresponding to the paper thickness, to a controller or the CPU 19.

Figure 6:
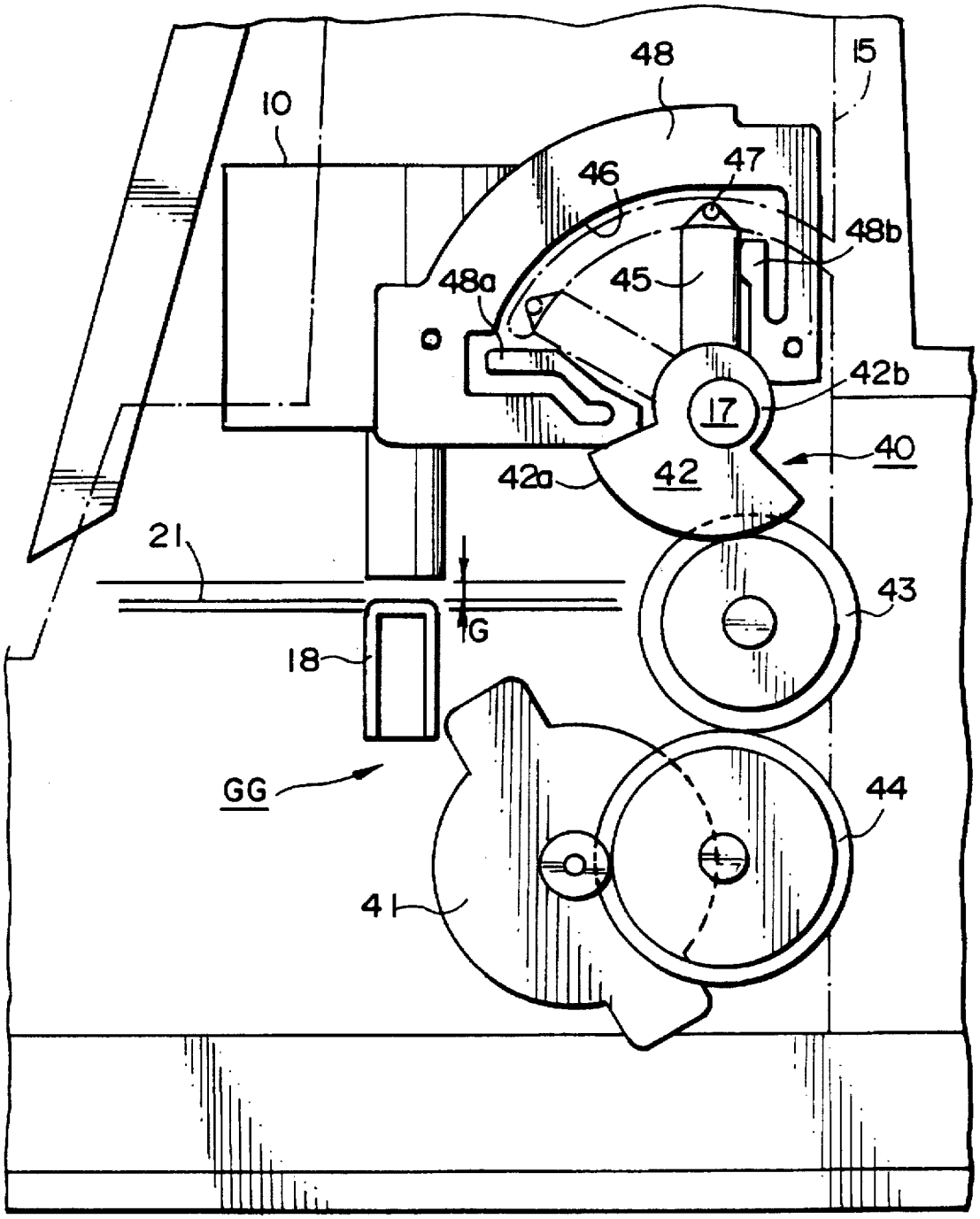
FIG. 6 shows main elements of a gap adjusting device of the present invention.

Referring to FIGS. 3 and 6, the gap adjusting device GG utilizes a signal derived from the distance signal at the CPU. The gap adjusting device GG thereby adjusts the gap G such that the print head 10 carries out a printing operation while retaining a constant space between the print head 10 and the surface of the paper material on the platen 18 by moving the print head 10 toward/away from the platen 18 according to the thickness of the paper material supplied. The gap adjusting device GG comprises a pulse motor 41 which imparts a driving force to the print head 10 via a driving force transmission mechanism 40, so as to move the print head 10 toward/away from the platen 18. The CPU 19 controls the amount of rotation of the pulse motor 41 according to a signal, corresponding to the paper thickness, from the paper thickness detector 27.

The driving force transmission mechanism 40 includes a displacement gear 42 rotatably supported by the frame 15. The displacement gear 42 eccentrically supports the carriage shaft 17. The displacement gear 42 has a coaxial sector gear 42*a*. A driving force from the pulse motor 10 is reduced by the two transmission gears 43 and 44, and then acts on the coaxial gear 42*b* so as to rotate the displacement gear 42 about an axis 42*b*. For example, when the displacement gear 42 rotates clockwise in FIG. 6, the carriage shaft 17 is lowered accordingly, thereby causing the print head 10 to descend vertically. On the contrary, when the displacement gear 42 rotates counterclockwise in the same figure, the carriage shaft 17 is raised, thereby causing the printer head 10 to ascend vertically.

A gap lever 45, which serves as an abutment member, is integrally connected to the displacement gear 42 of the driving force transmission mechanism 40. A guide axis 47 is attached to the tip of the gap lever 45 for moving within an arc-like guide slot 46 formed on the frame 15. The extent of swinging movement of the gap lever 45 is restricted by a single stop plate 48 fixed to the frame 15 by screws. The stop plate 48 has a first stop 48*a* and a second stop 48*b*. The first stop 48*a* is abutted on by the gap lever 45 (as indicated with a dash line) so as to restrict the movement of the print head 10 away from the platen 18 when the pulse motor 41 drives the print head 10 to move away from the platen 18. The second stop 48*b* is abutted on by the gap lever 45 so as to restrict the movement of the print head 10 toward the platen 18 when the pulse motor 41 drives the print head 10 to approach the platen 18. When the gap lever 45 abuts on the first stop 48*a*, the pulse motor 41 tries to continue rotating, so that the pulse motor 41 is resultantly brought into the out-of-phase condition, thereby assuming an initial condition. The initial condition is determined to be a reference position of the print head 10. The amount of rotation of the pulse motor 41 is controlled by the number of pulses since the initial condition, whereby the print head 10 can be vertically moved in accordance with the amount of rotation. The minimum gap between the print head 10 and the platen 18 can be defined by abutting the gap lever 45 on the second stop 48*b*. The minimum gap is defined so as to accommodate the thinnest paper material to be printed, such as 0.3 mm.

It is noted that the first and second stops 48*a* and 48*b* are formed in the shape of an arm capable of being plastically deformed. The plastic deformation of the stops 48*a* and 48*b* realizes a finely adjusted gap for establishing the initial condition and a finely adjusted minimum gap.

In operation, when the impact dot printer P is switched on, the pulse motor 41 is automatically activated under the control of the CPU 19. The pulse motor 41 continues driving the print head 10 to move away from the platen 18. The driving force imparted from the pulse motor 41 is transmitted and reduced by two transmission gears 43 and 44 so as to rotate the displacement gear 42 clockwise in FIG. 6. The pulse motor 41 tries to continue rotating after the gap lever 45 abuts on the first stop 48*a*, as a result, the pulse motor 41 is brought into the out-of-phase condition. The position assumed by the print head 10 is then determined as a reference position thereof.

As described in the above, since the highest position of the print head 10 is used as a reference position, it is possible to establish a reference position corresponding to an initial condition of the pulse motor 41, without having the print head 10 actually contact a paper material to be printed on. As a result, the risk of causing damage to dot pins attached to the print head 10 can be avoided.

Subsequently, a paper material is advanced horizontally toward the print head 10 via the paper feeding main slot 13, using the paper feeding table 12. As is apparent from FIG. 3, the paper material held by the first feeding roller means 22 is forcefully advanced to the print head 10 by being held by the cylindrical rollers 25, 25. As is apparent from FIG. 5, the reflection lever 32 of the paper thickness detector 27 traces the surface of the paper PP, and swings around the axis 33 by a swing angle corresponding to the thickness of the paper material PP. The paper thickness is transformed into the swinging movement of the reflection face 32*c* in an amplified manner, so that a distance between the photo sensor 31 and the reflection face 32*c* can be detected based on the light intensity distribution of the reflected light. The distance signal from the photo sensor 31 is transmitted to the CPU 19, which in turn controls the amount of rotation of the pulse motor 41 based on the distance signal, corresponding to the paper thickness, from the paper thickness detector 27. The pulse motor 41 is rotated under the foregoing control by the amount according to the control signal starting from the initial condition, so that the print head 10 stops after moving from the reference position by a predetermined amount. In this way, a print head 10 moves horizontally while having a constant space between the surface of the paper material on the plate 18, thereby carrying out a printing operation.

While the paper material passes through the gap G, the paper thickness detector 27 continuously detects the paper thickness so that the gap G is consistently adjusted as the paper material advances. As a result, the print head 10 can always secure the optimum extent of the gap G, even if the paper thickness varies during the printing operation. Further, since the paper thickness detectors 27 are arranged in the direction of paper width as well, it is possible to secure the optimum extent of the gap G not only in the foregoing case where the paper thickness varies in the longitudinal direction, but also in the case where it varies in the direction of paper width.

The paper material having been printed with the print head 10 is eventually guided by the guide plane 21 so as to be picked up from the paper feeding sub-slot 20.

In this impact dot printer P, it is possible to feed a paper material via the paper feeding sub-slot 20, so that the print head 10 carries out a printing operation with respect to the paper material. In this case, the paper thickness detector 27 detects the paper thickness, whereby the gap adjusting device GG can adjust the gap G so as to be the optimum size according to the detected paper thickness.

What is claimed is:

1. A gap adjusting device of an impact dot printer, comprising:

a print head;

a platen defining a gap between the print head and the platen for allowing a paper material to be printed on to pass through;

a pulse motor imparting a driving force to the print head through a driving force transmission mechanism so as to move the print head toward/away from the platen;

a paper thickness detector detecting paper thickness of the paper material passing through the gap;

a controller controlling an amount of rotation of the pulse motor based on a signal, corresponding to the paper thickness, from the paper thickness detector so as to adjust the extent of the gap in accordance with the paper thickness, by moving the print head;

an abutment member connected to the driving force transmission mechanism;

a first stop to be abutted by the abutment member for restricting movement of the print head in a direction away from the platen when the print head is driven by the pulse motor to move away from the platen; and a second stop to be abutted by the abutment member for restricting movement of the print head in a direction toward the platen when the print head is driven by the pulse motor to move toward the platen; wherein said pulse motor is brought into an out-of-phase condition by abutting said abutment member on said first stop so as to establish a maximum movement position of the print head when said paper material is being fed into said printer, the extent of the gap being adjusted toward said platen in accordance with the paper thickness, based on said maximum movement position.

2. A gap adjusting device of an impact dot printer according to claim 1, wherein the paper thickness detector monitors paper thickness of the paper material passing through the gap so as to continuously adjust the extent of the gap as the paper material advances.

3. A gap adjusting device of an impact dot printer according to claim 1, wherein the paper thickness detector includes:

a reflection lever having a reflection face which moves in response to the paper thickness, for tracing a surface of the paper material; and a stationary reflecting photo sensor for emitting light to the reflecting face and receiving the thus reflected light from the reflecting face.

4. A gap adjusting device of an impact dot printer according to claim 1, wherein the device includes a plurality of paper thickness detectors positioned a distance apart from one another in a direction orthogonal to a feeding direction in which the paper material passing through the gap advances.

5. A gap adjusting device of an impact dot printer according to claim 4, wherein at least one of the paper thickness detectors is positioned upstream of the gap, while others are positioned downstream of the gap.

* * * * *